United States Patent [19]

Roccaforte

[11] Patent Number: 4,688,677

[45] Date of Patent: Aug. 25, 1987

[54] FLIP TOP DISPENSER BOX WITH NON-LINEAR PERFORATIONS

[75] Inventor: Harry I. Roccaforte, Western Springs, Ill.

[73] Assignee: Waldorf Corporation, St. Paul, Minn.

[21] Appl. No.: 467,279

[22] Filed: Feb. 17, 1983

Related U.S. Application Data

[63] Continuation of Ser. No. 273,930, Jun. 15, 1981, abandoned.

[51] Int. Cl.[4] ..... B65D 5/54

[52] U.S. Cl. ..... 206/624; 229/44 CB

[58] Field of Search ..... 206/624, 625, 627, 621, 206/630, 606, 409, 494, 434; 229/44 CB, 39 R, 32 R, 40, 43

[56] References Cited

U.S. PATENT DOCUMENTS

| | | | |
|---|---|---|---|
| 2,964,231 | 12/1960 | Hanselman, Jr. et al. | 206/624 |
| 2,967,010 | 1/1961 | Cuffey, Jr. et al. | 206/624 |
| 3,777,957 | 12/1973 | Buttery | 229/175 |
| 3,833,165 | 9/1974 | Hoiles | 206/624 |
| 3,963,173 | 6/1976 | Stone | 229/44 CB |
| 4,127,229 | 11/1978 | Roccaforte | 229/44 CB |
| 4,284,197 | 8/1981 | Meyers | 206/626 |
| 4,289,239 | 9/1981 | Meyers | 206/624 |
| 4,298,123 | 11/1981 | Roccaforte et al. | 206/396 |

*Primary Examiner*—Stephen Marcus
*Assistant Examiner*—B. Gehman
*Attorney, Agent, or Firm*—Dorsey & Whitney

[57] ABSTRACT

A flip top dispenser box is formed from a single, integral planar paperboard blank which is folded into a generally rectangular parallelopiped, and is sealed along lines of weakness joining an upper and lower portion of the opposed side walls and front wall of the box. The line of weakness along the front wall is characterized by a cut line interrupted by at least two spaced arrays of non-linear perforations, while the line of weakness along each side wall is characterized by a cut line leading to a series of perforations disposed in parallel relationship and at a predetermined angle relative to said cut line. The arrays of non-linear perforations and the series of parallel perforations provide structural integrity for maintaining the flip top dispenser box in its sealed condition, until such time as the seal is broken so as to gain access to the contents of the box by rotating the cover of the box to sever the perforations.

1 Claim, 8 Drawing Figures

FLIP TOP DISPENSER BOX WITH NON-LINEAR PERFORATIONS

This is a continuation of application Ser. No. 273,930, filed June 15, 1981, now abandoned.

BACKGROUND OF THE INVENTION

1. Field of the Invention

The subject invention is an improvement in the flip top dispenser box disclosed in U.S. Pat. No. 4,127,229 which issued to the applicant on Nov. 28, 1978, entitled "FLIP TOP DISPENSER BOX", and assigned to the assignee of the subject application. U.S. Pat. No. 4,127,229 is incorporated herein by reference. The subject invention discloses an end seal flip top dispenser box, and more particularly, a box designed to contain a roll of sheet material, such as chemically impregnated sheet material, which is used to dispense portions of the sheet after the box seal is broken. The subject invention provides a flip top dispenser box of improved structural integrity which is particularly important when the roll of sheet material within the carton is relatively heavy, and thus the box must be of greater strength along the lines of weakness during the initial shipping and storage of the box when in its sealed condition, prior to being opened by the consumer.

2. Description of the Prior Art

Cartons or boxes which are adapted to contain and dispense sheets of material from a roll housed within the box are usually equipped with a cutting member, such as a strip of metal having a serrated edge over which the sheet may be drawn for cutting the sheet to a desired length. Exemplary patents illustrating such cartons are disclosed in U.S. Pat. Nos. 3,128,025; 3,137,424; 3,531,032; 3,722,767; and 3,777,957.

In U.S. Pat. No. 3,531,032, in lieu of a separate tear strip which obviously increases manufacturing costs, the cover of the dispensing carton is connected to the side walls by weakened lines of separation when the box blank is formed. Hence, the cover seals the contents of the box, but when raised, the cover separates from the side walls to break the seal. Such a construction results in the elimination of the tear strip, and the carton is filled from the side and flaps forming the side wall are then sealed to enclose the contents.

The flip top dispenser box disclosed in U.S. Pat. No. 4,127,229 also does not utilize an undesirable tear strip seal. Furthermore, the flip top construction of U.S. Pat. No. 4,127,229 is provided such that a portion of the front wall and the side walls of the box remain connected to the cover after the seal is broken. The improved flip top dispenser box of U.S. Pat. No. 4,127,229 is efficient for sealing the contents of the carton during shipping and storage, and is efficient in enabling the consumer to readily gain access to the contents of the box by merely rotating the cover of the box to sever the lines of weakness. In the flip top dispenser box of U.S. Pat. No. 4,127,229 the cover is formed with panel portion that is removable with the cover when the latter is opened, with said panel portion extending into side flaps and connected thereto by weakened lines of separation which primarily consist of perforations which are in the side flaps and aligned with the cut line defining said panel portion. It would be of significant advantage to enhance the structural integrity of the dispenser box along the lines of weakenss especially when a relatively heavy roll of sheet material is contained within the box, and such an advantage is an object of the present invention. It would also be of significant advantage to provide new and improved lines of weakness which, after severing, define clean severance lines, yet provide improved structural strength of the closure of the box, and such an advantage is another object of the subject invention.

SUMMARY OF THE INVENTION

Accordingly, the subject invention provides a flip top dispenser box of the type described, formed from a single, integral planar paperboard blank which is folded into a rectangular parallelopiped, and which includes lines of weakness having improved structural integrity prior to being severed when the box or carton is opened.

The subject dispenser carton is formed by folding panels and flaps from the single blank about horizontal and vertical score lines, and adhesively securing the rear surface of the inner front panel to the outer surface of the outer front panel at the top of the blank to form a rectangular box. The roll of sheet material is then inserted into the rectangular box from a side thereof, and the side flaps are then folded at right angles into overlapping relationship and sealed.

The outer top front panel overlaps the top edge of the lower front panel of the box so that the outer top front panel can be grasped by the consumer and rotated upwardly and rearwardly with the top cover to sever the weakened lines of separation now forming the box seal between the cover and side walls, thereby exposing the roll of sheet material in the box. The lines of weakness are characterized by an interrupted or discontinuous linear cut line extending along the front panel of the carton and including at least two spaced arrays of non-linear perforations, with each array of perforations preferably comprising two sets of arcuate perforations disposed on opposite sides of the axis of the linear cut line. Along each said wall of the dispenser box, an angular cut line is provided along with a series of perforations disposed at the same predetermined angle, and thus parallel relative to the cut line, with the series of perforations being disposed adjacent the hinge line for the cover. The series of perforations extend generally perpendicular to the planes of the top and bottom walls of the box. In the sealed condition of the dispenser box, the series of perforations provide additional structural integrity for the line of weakness, whereas upon rotation of said cover, the alignment of said series of perforations aids in providing a clean line of separation of the cover relative to the side walls. The new and improved lines of weakness in the flip top dispenser box of the subject invention are particularly effective when the dispenser box is used for containing chemically impregnated sheets of material which have a relatively high unit weight.

Further objects and advantages of the invention will become apparent from the foregoing description and claims and from the accompanying drawings.

DETAILED DESCRIPTION OF THE PREFERRED EMBODIMENTS

Figure 1:
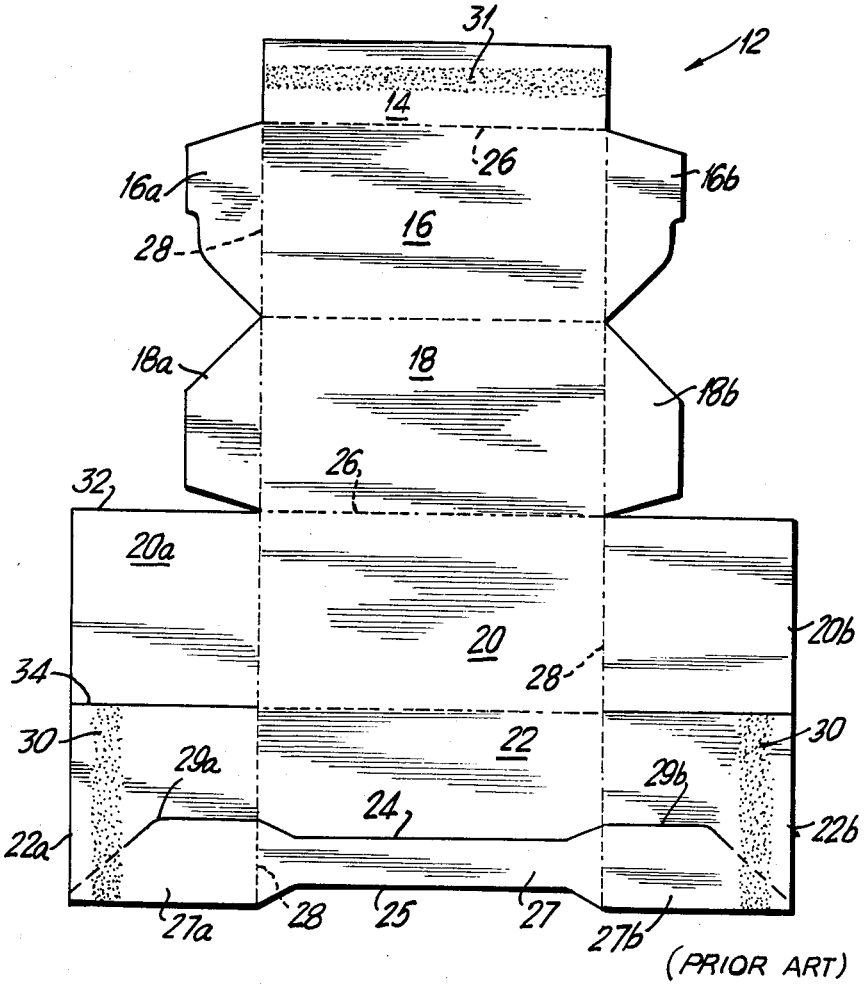
(PRIOR ART) FIG. 1
FIG. 1 is a plan view of a blank for forming a flip top dispenser box according to the prior art, and more particularly as disclosed in U.S. Pat. No. 4,127,229.
Figure 2:
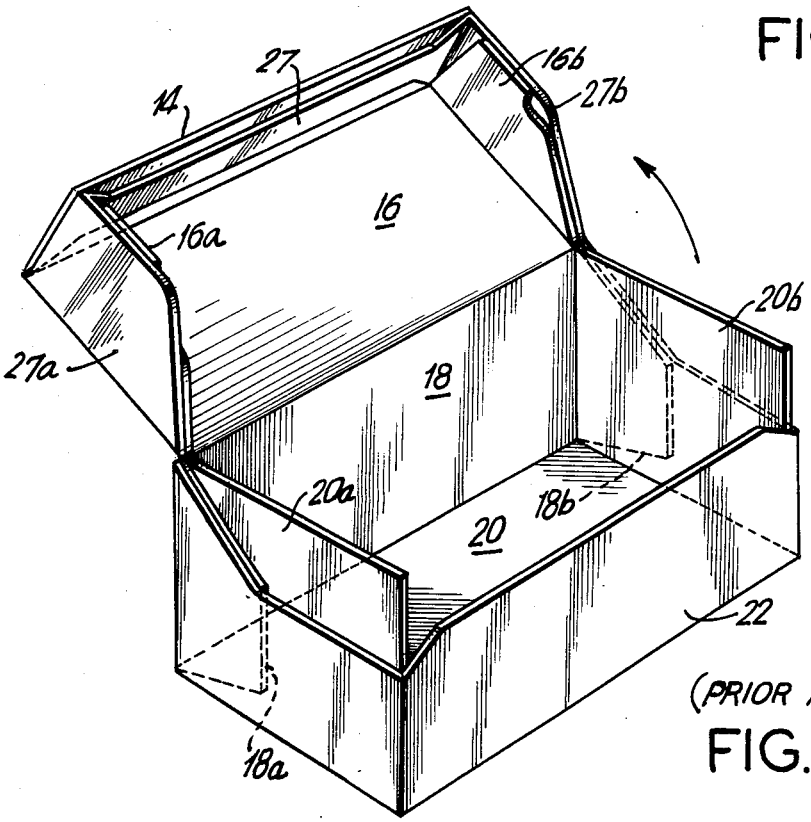
(PRIOR ART) FIG. 2
FIG. 2 is a perspective view of the prior art flip top dispenser box of U.S. Pat. No. 4,127,229, with the cover open.

Referring to FIGS. 1 and 2, the prior art box 10 made according to the teachings of U.S. Pat. No. 4,127,229 is formed from a single, planar, unitary paperboard blank 12. The latter includes five vertically aligned, substantially rectangular panels 14, 16, 18, 20 and 22 which are joined to each other by horizontal score lines 26. Each rectangular panel 16, 18, 20 and 22 includes a left laterally extending flap and a right laterally extending flap, respectively designated 16*a*–22*a* and 16*b*–22*b* corresponding to each panel 16–22 to which it is joined. The respective flaps are joined to their corresponding panel by vertical score lines 28, 28.

The bottom rectangular panel 22 is cut along a substantially horizontal line 24 which extends parallel to the bottom edge 25 of the rectangular panel 22 to form a separable or detachable panel 27. The latter has opposite flaps 27*a*, 27*b* joined by vertical score lines 28, 28 to the panel 27. The flaps 27*a*, 27*b* are joined to flaps 22*a*, 22*b*, respectively, by weakened lines of separation 29*a* and 29*b* formed by scoring of the blank 12. It is noted that the respective score lines 29*a*, 29*b* are defined in part by cut lines which extend at an angle and which subsequently engage a series of aligned perforations that extend along the respective cut line 29*a*, 29*b*.

In the assembly of the box 10 from blank 12, the latter is first folded substantially in half about score line 26 thereby connecting panels 18 and 20. The panel 14 is then folded downwardly about its score line 26 to overlie panel 27 and has its outer surface adhesively secured to the inner or reverse surface of panel 27 by an adhesive line, designated by the numeral 31. Panels 16, 18, 20 and 22 are then all folded and pivoted 90° relative to each other about their respective horizontal score lines 26 so as to form a rectangular enclosure. Panel 22 forms the lower front of box 10 (see FIG. 2) and is disposed in a plane perpendicular to panel 20 which forms the bottom of the box 10. Panel 18 is also disposed in a plane perpendicular to the panel 20 and parallel to panel 22 to form the back of the prior art box 10. Panel 16 is disposed in a plane parallel to panel 20 to form a top or cover for box 10, while panel 14 is disposed in a plane parallel to back panel 18 to thereby form the upper, outer front panel which overlies the top edge of lower front panel 22. Since panel 27 is secured to the inner surface of panel 14, panel 27 thus forms an upper inner front panel.

Following partial erection of the prior art box 10, the latter is filled with a roll of material through either open side after which the side flap structures are closed and secured by adhesive strips 20. Flaps 27*a*, 27*b* form the upper, opposite sides of box 10 and overlie side flaps 16*a*, 16*b*, respectively, of cover 16. Adhesive 30 secures each side flap pair 16*a*, 27*a* and 16*b*, 27*b* together, while upper side wall portions 27*a*, 27*b* are secured to the lower side wall portions 22*a*, 22*b*, respectively, by the second lines of weakness 27*a* and 27*b* respectively. As shown in FIG. 2, the prior art box 10 is thus completely sealed. In order to open the box 10, it is necessary to grasp the lower edge of the upper front panel 14 and rotate the cover 16 backwards. In the erected condition of the prior art carton, since the line 24 is a cut line, and since the lines of weakness 29*a* and 29*b* are merely held together by the aligned perforations, it is merely necessary to rotate the cover 16 backwards so as to cause the perforations in the lines of weakness 29*a*, 29*b* to separate the upper and lower side wall panels thereby providing access to the interior of the box 10.

As indicated above, in certain applications wherein the flip top dispenser box of the type disclosed in U.S. Pat. No. 4,127,229 is employed in conjunction with relatively heavy sheet material, such as chemically impregnated sheets of material rolled in an elongated tubular roll, it is desirable to provide additional structural integrity for the sealed box. The subject invention provides the structural integrity in a new and unique manner, as more specifically embodied in the first embodiment of the invention as illustrated in FIGS. 3 through 6.

Figure 3:
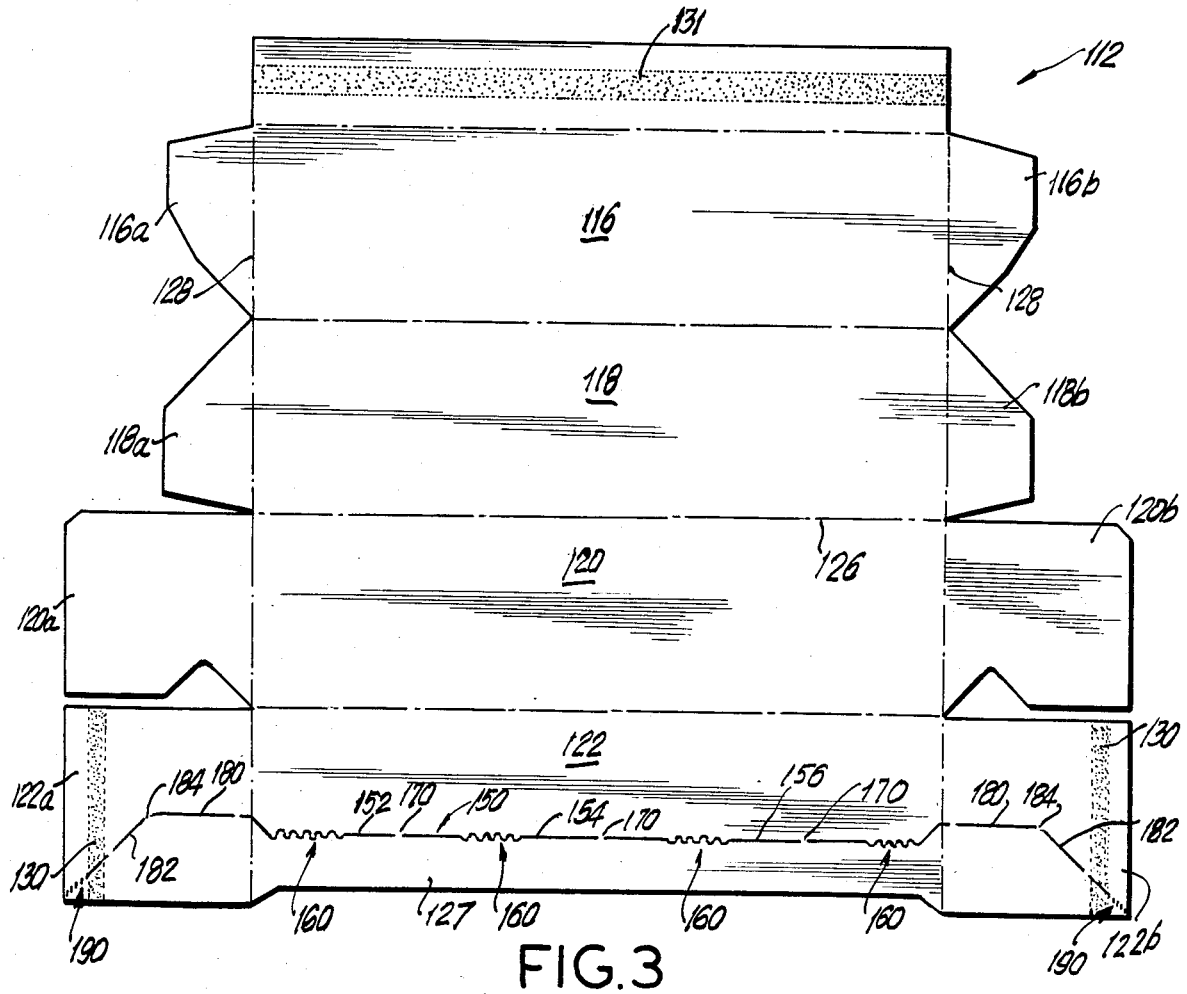
FIG. 3 is a plan view of a blank for forming a flip top dispenser box according to a preferred embodiment of the subject invention.
Figure 4:
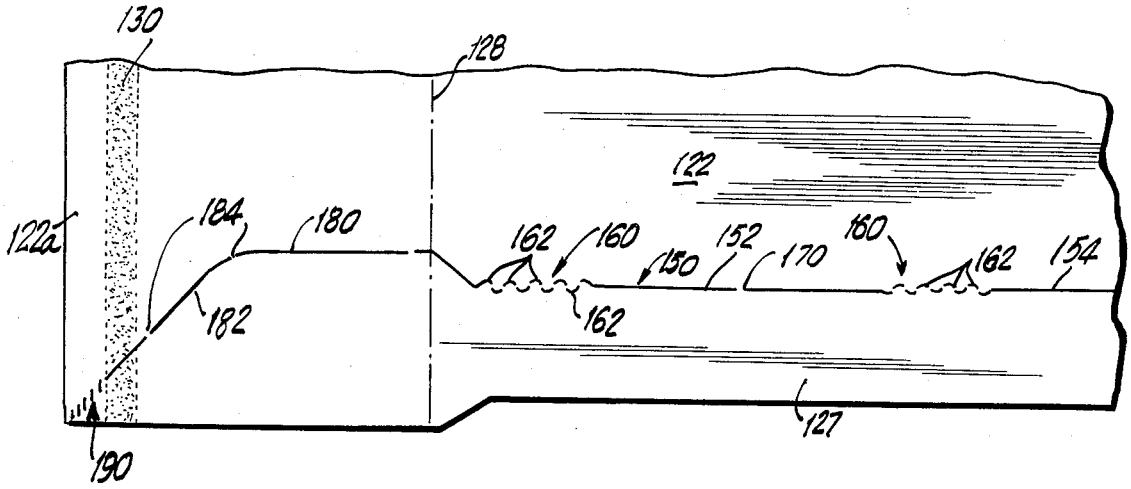
FIG. 4 is a detailed plan view of the lines of weakness formed in the blank of FIG. 3.
Figure 5:
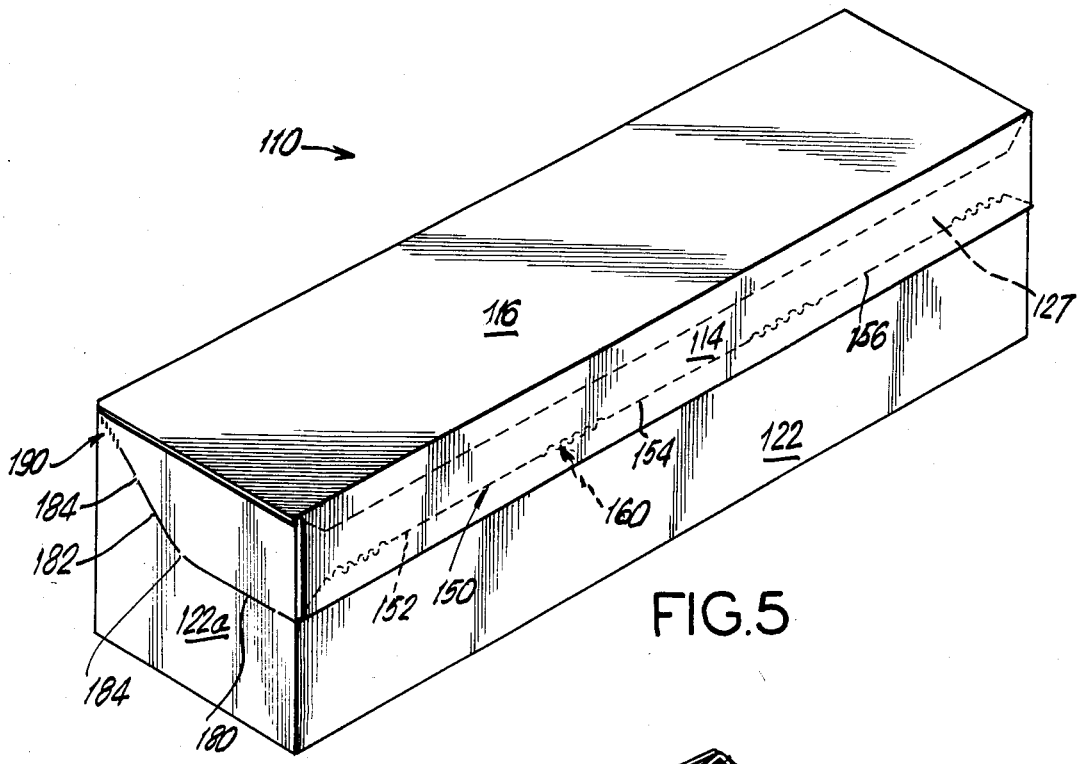
FIG. 5 is a perspective view of the flip top dispenser box of a preferred embodiment of the present invention.
Figure 6:
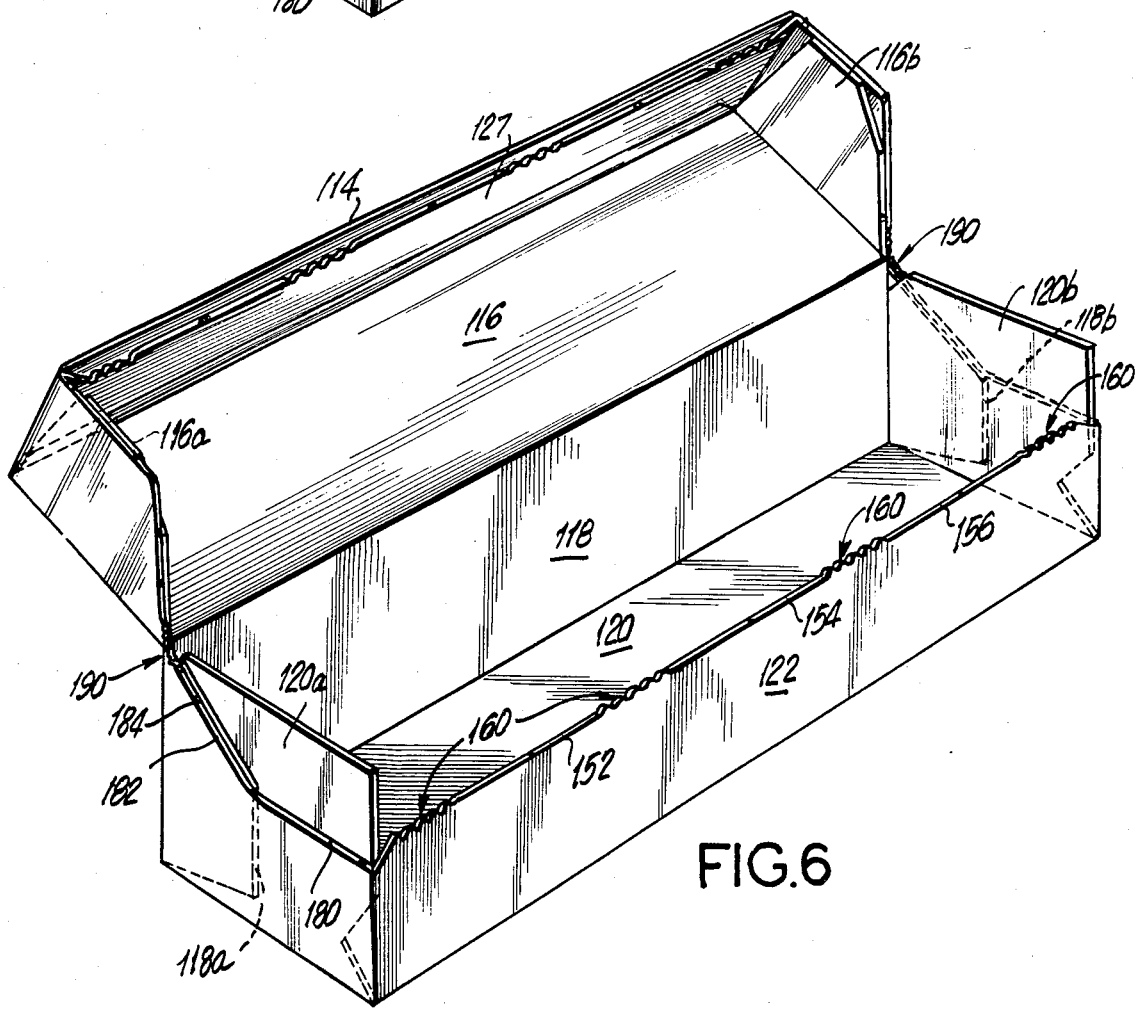
FIG. 6 is a perspective view of the dispenser box of FIG. 5 with the cover open.

Referring to FIG. 3, wherein like numbers indexed upwardly by 100, correspond to like structure in the embodiment of the prior art box as disclosed in U.S. Pat. No. 4,127,229, the new and improved blank 112 of the subject invention includes panel 127 that is hingedly and detachably connected to the remaining portion of the front wall panel 122 along a line of weakness, designated by the numeral 150. The latter is characterized by aligned linear cut line segments 152, 154 and 156 that are spaced by intermediate arrays of non-linear perforations, designated by the numeral 160. At least two arrays of non-linear perforations 160 are provided in the front wall panel 122. As shown in greater detail in FIG. 4, four arrays of non-linear perforations 160 are provided in panel 122, with each array of non-linear perforations being formed of a plurality of hemispherical cut lines 162 which are alternatively disposed in transverse relationship on opposite sides of the axis of line 150 and are spaced so as to provide a continuous structural interconnection between the detachable panel 127 and the front wall panel 122. Further structural integrity of the interconnection between the front wall 122 and the detachable panel 127 may be provided by interrupting the respective cut lines 152, 154 and 156, as at 170. The line of weakness 150 further includes tearable hinge lines 180, 180, each of which includes angular cut line portion 182 that is interrupted as at 184 for additional structural rigidity. Each angular cut line portion 182 terminates in a series of perforations 190 that are disposed in parallel array, at an angle to the angular cut line segment 182. As shown in FIG. 5, preferably, each perforation in the series of parallel perforations 190 extends normal to the planes of the top wall 116 and the bottom wall 120 of the flip top dispenser box 110.

In the erected sealed condition of the new and improved flip top dispenser box 110 of the subject invention, as illustrated in FIG. 5, the line of weakness 150 is effectively reinforced by virtue of the spaced arrays of non-linear perforations 160 acting in combination with the interrupted portions of the cut lines 152, 154, and 156, as well as the interrupted portions of the tearable hinge lines 180 and the parallel arrays of perforations 190 in maintaining the flip top box 110 in the closed and sealed condition. This is of particular importance when the flip top box 110 is utilized for containing relatively heavy sheets of material, such as chemically impregnated sheets of material rolled in a tubular form. The additional structural integrity of the flip top dispenser box 110 aids in insuring that the contents remain sealed and in a closed position during shipment and display on a store shelf, until such time as a consumer breaks the line of weakness 150 to gain access to the interior of the box 110. At such time, the cover 116 is rotated backwards, thereby breaking the connections at the arrays of non-linear perforations 160, the points 170 and 184, as well as causing tearing of the hinge lines 180 along the angular line portions 182 and through the series of perforations 190. Since all of the perforations in the series of perforations 190 are disposed at the same predetermined angle with respect to the angular cut line portions 182, an optimum condition is effected which provides for ease of tearing through said series of perforations 190, yet which provides enhanced strength against accidental tearing during handling and/or storage of the flip top dispenser box 110.

Figure 7:
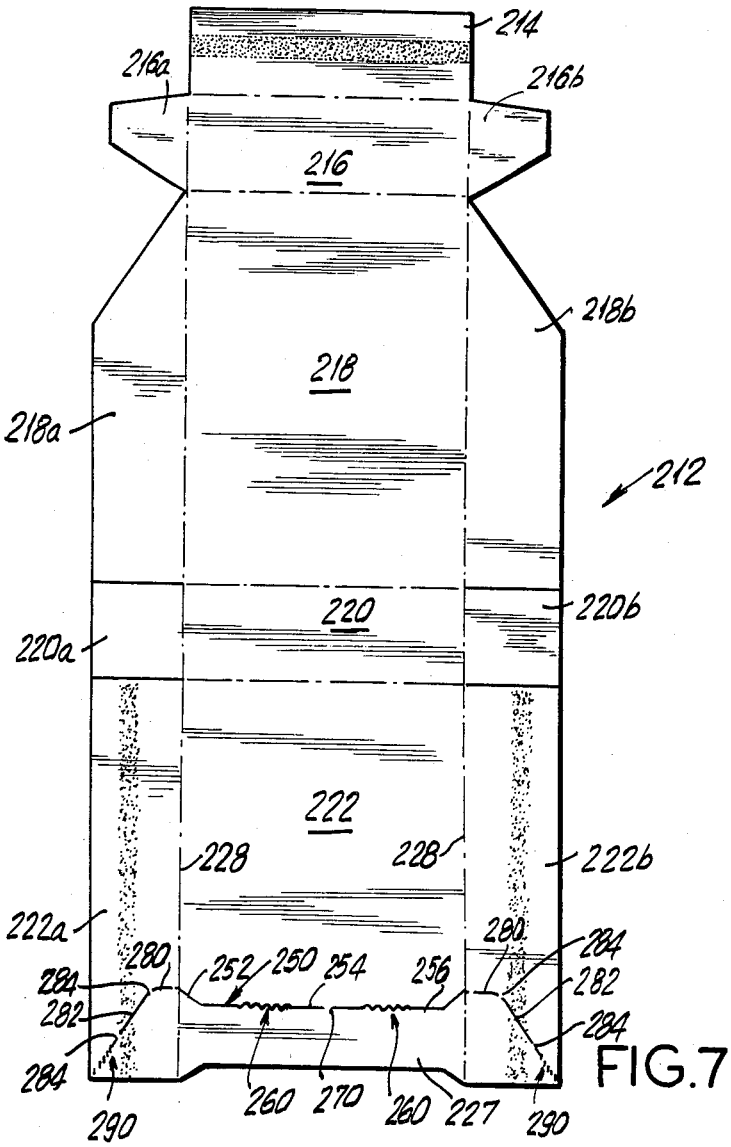
FIG. 7 is a plan view of a blank according to a second embodiment of the subject invention.
Figure 8:
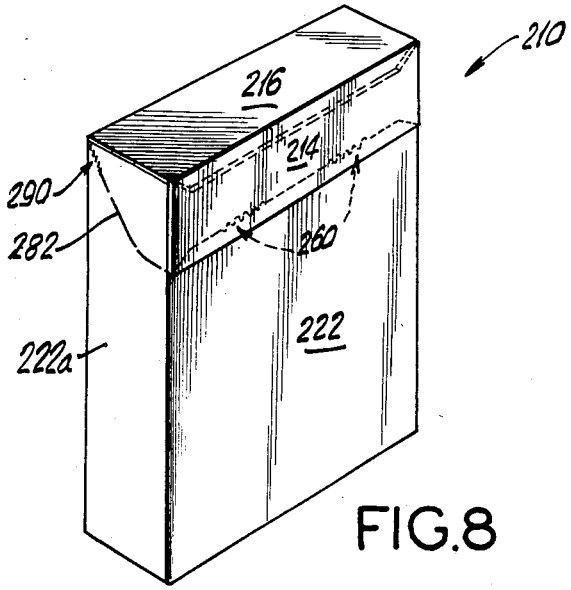
FIG. 8 is a perspective view of the flip top dispenser box according to the second embodiment of the present invention.

Turning to FIGS. 7 and 8, an alternate embodiment of the flip top dispenser box according to the subject invention is illustrated. Flip top dispenser box 210 is formed from a single blank 212 comprising hingedly connected front cover panel 214, top panel 216, back panel 218, bottom panel 220 and front panel 222. Top panel 216 includes side flaps **216*a* and 216*b*, while back panel 218, bottom panel 220 and front panel 222 include side panels 218*a*–222*a* and 218*b*–222*b*, respectively. The front panel 222 includes a detachable flap portion 227 which is connected thereto by means of a line of weakness 250. The latter is basically similar to the line of weakness at 150 provided in the first embodiment of the subject invention as illustrated in FIGS. 3 through 6, and includes two arrays of non-linear perforations 260, aligned cut line segments 252, 254 and 256 which may be interrupted as at 270, as well as tearable hinge line segments 280, 280 having angular cut line portions 282, each terminating in a series of perforations 290 that are disposed in parallel relationship and at an angle to the associated angular line portion 282. Preferably, each array of non-linear perforations 260 is disposed closer to the adjacent vertical hinge line 228, 228 then to the central portion of the line of weakness 250 whereby, in the erected condition of the dispenser box 210 as illustrated in FIG. 8, each array of nonlinear perforations 260 is disposed closer to an opposed side wall of the box then to a plane extending centrally between the parallel side walls of the flip top dispenser box. As in the first embodiment of the subject invention, the flip top dispenser box 210 of the subject invention has enhanced structural integrity in its sealed condition by virtue of the specific construction of the line of weakness 250. Furthermore, upon opening of the cover 216, the alignment of the series of perforations 290 aids in providing a clean line of separation of the cover relative to the respective side wall. Line portions 282 may be interrupted as at 284**.

Although the invention has been described with respect to the specific embodiments thereof, it is readily apparent that changes, modifications and alterations may be made therein without departing from the spirit and scope of the invention as defined by the appended claims.

What is claimed is:

1. An improved flip top dispenser box comprising:

a front wall, a back wall, top and bottom walls, and opposing side walls;

said front wall including a lower member hingedly connected to one end thereof to said bottom wall; a detachable member hingedly and releasably connected to said lower member; and a top member overlapping and being adhered to said detachable member and a portion of said lower member, one end of said top member having a gripping edge, the other end of said top member being hingedly connected to said top wall;

each of said side walls including an inner wall member and hingedly connected to the bottom wall; each of said inner side wall members having approximately the same height as said back wall, each of said side walls further including an outer wall member, each of said outer wall members including a lower portion hingedly connected to the lower member of said front wall and overlapping and being adhered to a portion of its respective inner side wall member, each of said outer side wallsl further including a top portion which is contiguous with and releasably connected to its respective lower outer side wall portion, each top outer side wall portion being hingedly connected to the detachable member of said front wall, wherein the improvement is characterized by said detachable member being hingedly and releasably connected to said lower member by a series of three coaxial linear cut lines of substantially equal length which are spaced from each other by two intervening arrays of non-linear perforations and there being two further arrays of non-linear perforations disposed between the endmost ones of said coaxial cut lines and respective ones of said opposing side walls, each of said arrays of non-linear perforations comprising two sets of arcuate perforations disposed on opposite sides of the axis of said linear cut lines; and wherein each said top portion of said outer side walls is releasably and hingedly connected to its respective lower outer side wall portion along a tearable hinge line formed of an angular linear cut line and a series of parallel linear perforations disposed at the same predetermined angle relative to said angular cut line and generally perpendicular to said top and bottom walls, said parallel linear perforations extending from one end of said angular linear cut line to a free edge of said outer side wall members, whereby said arrays of non-linear perforations and series of perforations ensure the structural integrity of the sealed flip top dispenser box.

* * * * *